United States Patent [19]

Katoh et al.

[11] Patent Number: 4,771,317

[45] Date of Patent: Sep. 13, 1988

[54] DUAL SCANNING MODE

[75] Inventors: Itsuro Katoh; Shunju Anzai, both of Nara, Japan

[73] Assignee: Sharp Kabushiki Kaisha, Osaka, Japan

[21] Appl. No.: 886,255

[22] Filed: Jul. 16, 1986

[30] Foreign Application Priority Data

Jul. 16, 1985 [JP] Japan ..... 60-156271
Jul. 16, 1985 [JP] Japan ..... 60-156272
Jun. 12, 1986 [JP] Japan ..... 61-137958

[51] Int. Cl.[4] ..... G03G 15/00

[52] U.S. Cl. ..... 355/8; 355/14 R; 355/14 SH

[58] Field of Search ..... 355/8, 14 R, 14 SH, 355/46, 51

[56] References Cited

U.S. PATENT DOCUMENTS 4,162,848 7/1979 Platt ..... 355/46 X
4,204,730 5/1980 Miyashita et al. ..... 355/51 X
4,508,444 4/1985 May et al. ..... 355/8 X

*Primary Examiner*—Arthur T. Grimley
*Assistant Examiner*—J. Pendegrass
*Attorney, Agent, or Firm*—Birch, Stewart, Kolasch & Birch

[57] ABSTRACT

A dual scanning mode copying machine capable of selectively operating under a primary scan mode, in which a document placed on a stationary document support is scanned by an optical system being moved below the document support, and under a secondary scan mode in which a document fed through a document feeder is moved relative to and above the optical system. The machine includes a detector for detecting the insertion of the document into the document feeder. When this detector detects the insertion of the document into the document feeder, the optical system is brought to a stationary position immediately below the document feeder and next to the document support.

6 Claims, 7 Drawing Sheets

DUAL SCANNING MODE

BACKGROUND OF THE INVENTION

The present invention generally relates to an electrophotographic copying machine and, more particularly, to a dual-mode copying machine wherein a copy can be made either in a primary scan mode in which an optical system is moved so as to scan a document to be copied placed on a stationary document support, or in a secondary scan mode in which the optical system is held stationary and a document to be copied is moved relative to the optical system.

Various types of electrophotographic copying machines are currently commercially available. Some of them are operable under a secondary scan mode, that is, are of the type having a movable document support and an immovable optical system, and the others are operable under a primary scan mode, that is, of a type having a stationary document support and a movable optical system. In other words, the conventional electrophotographic copying machines are available in either one of these two types.

Therefore, it often happens that relatively complicated and time-consuming procedures are required when a document that requires, for example, urgent copying is to be copied while different documents are being copied. More specifically, assuming that the copying machine is occupied by an office clerk who is making a number of copies from a single document, and in the even that another office clerk wishes to make a copy of an urgent document to be immediately copied, the first place document on the document support must be manually removed therefrom in favor of the urgent document and, at the same time, copy data associated with the urgent document must be entered in the machine. This is true even with the copying machine having an interrupted copying function. Moreover, after the completion of copy-making of the urgent document, the junior clerk's document (that is, the urgent document) must be removed from the document support and the senior clerk's document must be subsequently placed again on the document support for the continued copy-making of the senior clerk's document.

In this way, with the conventional copying machine of either type, the interruppted copying operation results in a complicated and time-consuming intervention.

SUMMARY OF THE INVENTION

The present invention has for its essential object to provide a dual-mode copying machine capable of selectively operating under a primary scan mode and a secondary scan mode, wherein the selection of one of these modes can be automatically achieved with no manual intervention required.

Another important object of the present invention is to provide a dual-mode copying machine of the type referred to above, wherein the loss of time resulting from the interruption of the operation of the copying machine which is necessitated to permit the urgent document to be copied during the execution of the copying operation is avoided.

A further object of the present invention is to provide a dual-mode copying machine of the type referred to above, wherein even when the urgent document is to be copied, any document once placed on the document support need not be removed therefrom in favor of the urgent document.

A still further object of the present invention is to provide a dual-mode copying machine which is easy to operate and wherein the interrupted copying operation can readily be accomplished with no substantial complicated and time-consuming procedure required.

In order to accomplish these objects, the present invention provides a copying machine capable of selectively operating under a primary scan mode, in which a document to be copied placed on a stationary document support is scanned by an optical system being moved below the document support, and under a secondary scan mode in which a document to be copied, fed through a document feeder, is moved relative to and above a fixed optical system. In one preferred embodiment, the copying machine comprises a first document sensing means for detecting the placement of the document on the stationary document support; a second document sensing means for detecting the insertion of the document into the document feeder; and a mode setting means for selectively setting the machine so as to operate under the primary scan mode when said first document sensing means has detected the placement of the document on, the stationary document support and under the secondary scan mode when the second document sensing means has detected the insertion of the document into the document feeder.

In another preferred embodiment, the copying machine comprises a mode changing means operable to interrupt the operation of the machine under the primary scan mode immediately after the completion of the copying operation under the primary scan mode and to initiate the operation under the secondary scan mode, in the event that a document is inserted in the document feeder during the execution of the copying operation under the primary scan mode.

In a further preferred embodiment of the present invention, the copying machine comprises a document sensing means for detecting the insertion of the document into the document feeder; a mode changing means operable, in the event that the document sensing means detects the insertion of a document during the execution of copying operation under the primary scan mode, to interrupt the copying operation under the primary scan mode immediately after the completion of a cycle of the copying operation and to execute the copying operation under the secondary scan mode; and a mode resuming means for causing the machine to resume the copying operation under the primary scan mode immediately after the completion of the copying operation under the secondary scan mode set by the mode changing means.

BRIEF DESCRIPTION OF THE DRAWINGS

These and other objects and features of the present invention will become readily understood from the following description thereof taken in conjunction with a preferred embodiment thereof with reference to the accompanying drawings, in which.

DETAILED DESCRIPTION OF THE INVENTION

Figure 1:
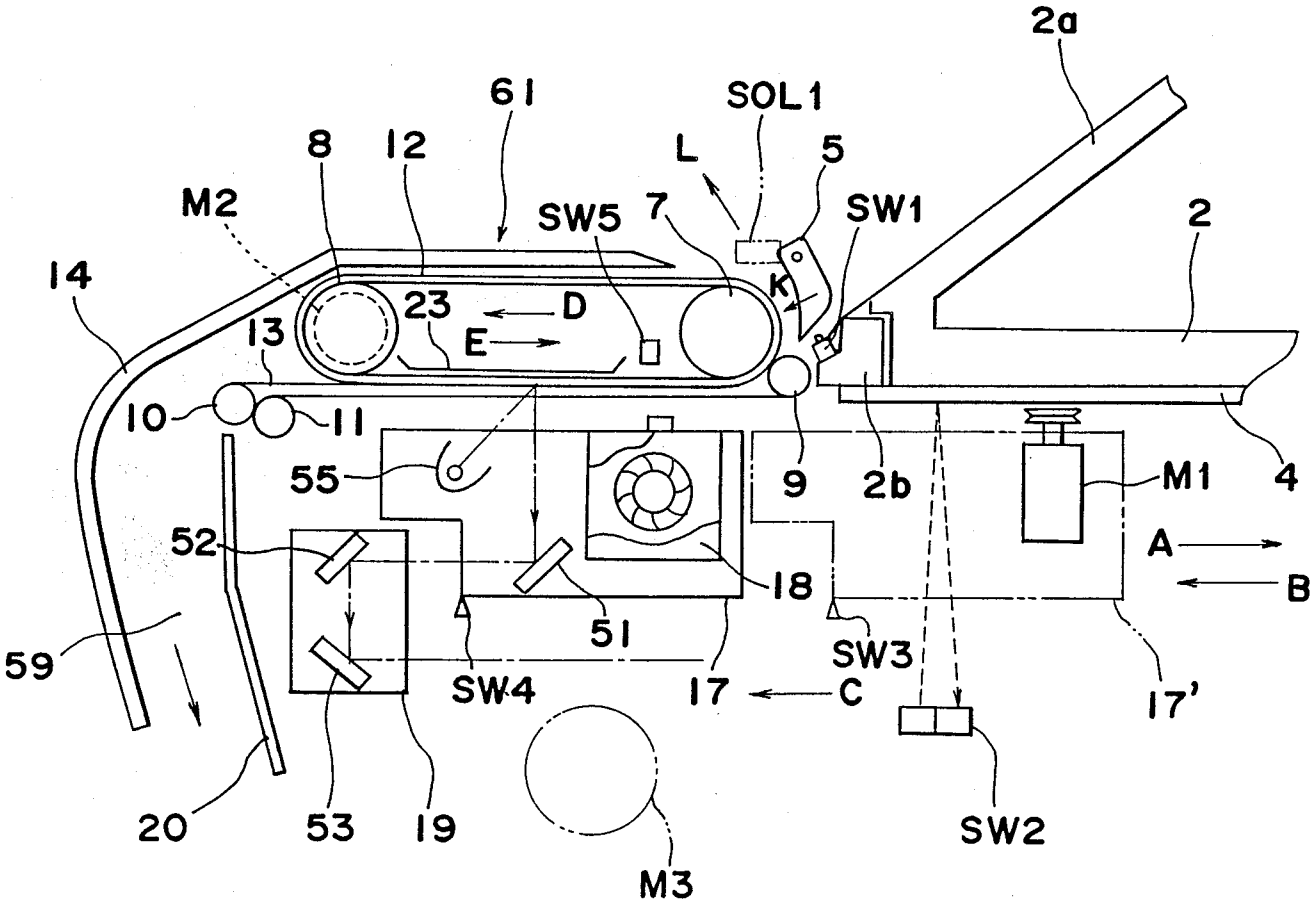
FIG. 1 is a front sectional view of an essential portion of a copying machine embodying the present invention.
Figure 2:
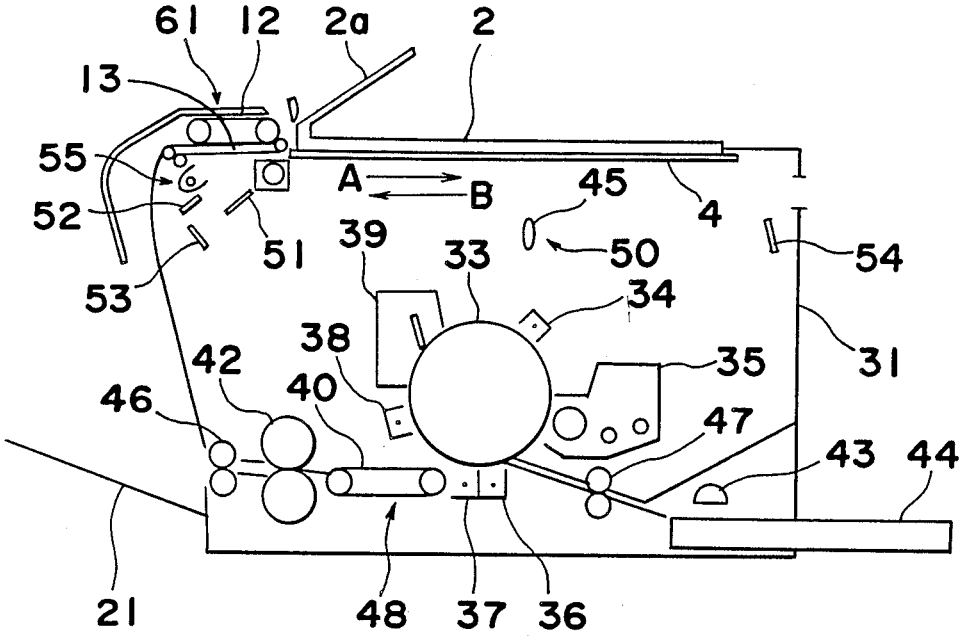
FIG. 2 is a schematic front sectional view of the copying machine.

Referring first to FIGS. 1 and 2, a copying machine embodying the present invention shown therein comprises a generally rectangular box-like housing 31 accommodating a photoreceptor drum 33 supported for rotation in one direction. During each complete rotation of the photoreceptor drum 33, the photoreceptor drum 33 moves sequentially past a plurality of processing stations disposed in the vicinity of and around the drum 33. These processing stations include a charging station at which an electrostatic charger 34 is disposed; an exposure station at which an imagewise light from an optical system 50 as will be described later, is projected onto the photoreceptor drum 33; a developing station at which a developing unit 35 is disposed for forming a powder image corresponding to an electrostatic latent image on the photoreceptor drum 33; a transfer station at which both a transfer charger 36 and a separator charger 37 are disposed for transferring the powder image onto a copying paper and separating the latter from the photoreceptor drum 33, and a cleaning station at which both an eraser charger 38 and a cleaning unit 39 are disposed for effecting discharge of any residual electrostatic charge remaining on the photoreceptor drum 33 and for removing any residual toner particles therefrom, respectively, in readiness for the next succeeding cycle of copying operation.

A paper tray 44 containing a stack of copying papers is removably inserted into the housing 31 so that any one of the copying papers can be fed by a feed roll 43 from the tray 44 towards the transfer station by way of a pair of juxtaposed PS rolls 47. The copying paper onto which the powder image has been transferred from the photoreceptor drum 33 at the transfer station by any known manner is thereafter ejected onto a receiving tray 21, opposite to the paper tray 44 with respect to the machine proper, after having been conveyed through a transport passage 48 including a belt conveyor 40, juxtaposed fixing rolls 42 and juxtaposed ejecting rolls 46.

The housing 31 has a stationary document support 4 constituted by, for example, a hard transparent plate glass mounted atop the housing 31. This document support 4 is adapted to be selectively opened and closed by a hingedly supported top cover 2 which, when in a closed position, covers and urges the document, placed on the document support 4, against it. The optical system 50 is supported within the housing 31 and above the photoreceptor drum 33 and immediately below the document support 4.

The optical system 50 so far shown comprises an illuminator lamp 55, a projector lens assembly 45, and a plurality of reflector mirrors 51 to 54 arranged in a pattern well known to those skilled in the art. Of the reflector mirrors, the reflector mirror 51 is mounted on a first carriage 17 together with the illuminator lamp 55 and a motor-driven fan 18, and the reflector mirrors 52 and 53 are mounted on a second carriage 19. The first and second carriages 17 and 19 are supported for reciprocal movement in respective directions, shown by A and B, parallel to the document support 4, it being, however, that the speed of movement of the first carriage 17 is selected to be twice that of the second carriage 19. The document to be copied placed on the document support 4 can be scanned by the illuminator lamp 55 during the movement of the first carriage 17 in the direction A accompanied by the corresponding movement of the second carriage 19 at a speed half the speed of movement of the first carriage 17, an imagewise light carrying the image of the document being, after having passed through the lens assembly 45 and reflected by the fixed reflector mirror 54, projected onto the photoreceptor drum 33 then rotated. The document to be copied placed on the document support 4, is sensed by a primary document sensor switch SW2 disposed within the housing 31 and positioned immediately below a left-hand end of the document support 4.

A document feeder generally identified by 61, the details of which are best shown in FIG. 1, is mounted atop the housing 31 and positioned next to the document support 4 on one side adjacent the receiving tray 21. This document feeder 61 comprises an endless drive belt 12, trained between drive and driven rolls 8 and 7, and an endless driven belt 13 trained between idle rolls 9 and 10 and disposed beneath the drive belt 12 with a lower run of the drive belt 12 contacting an upper run of the driven belt 13. The drive roll 8 is drivingly coupled with a fixed on a drive shaft of an electric reversible motor M2 so that the drive belt 12 can be driven in opposite directions shown by D and E one at a time. The driven belt 13 is made of a transparent, heat-resistant material.

For avoiding any possible fluttering motion of the drive belt 12, particularly, the lower run of the drive belt 12 during the movement thereof, a back-up plate or depressor plate 23 is disposed inside the drive belt 12 so as to contact the lower run of the drive belt 12 from inside. Also disposed inside the drive belt 12 is a photoelectric sensor SW5 cooperable with the illuminator lamp 55 to detect whether or not the document to be copied, which is given priority, has been fed in between the drive and driven belts 12 and 13 in a manner as will be described later. In any event, if the document is fed between the drive and driven belts 12 and 13, rays of light emitted by the illuminator lamp 55 and received by the photoelectric sensor SW5 are intercepted by the document being fed in between the drive and driven belts 12 and 13, particularly between the lower and upper runs of the respective belts 12 and 13 with the consequence that the photoelectric sensor SW5 ceases its generation of an output signal, that is, switched off.

For faciliating the feed of the document into a nipping region between the drive and driven belts 12 and 13, an inclined guide plate **2*a* is rigidly mounted on, or otherwise integrally formed with, the top cover 2 so as to incline downwardly towards the driven and idle rolls 7 and 9. The feed or slide of the document along the guide plate 2*a* into the nipping area between the driven and idle rolls 7 and 9 is detected by an auxiliary document sensor switch SW1 mounted fixedly on a guide 2*b* which is formed continuously with the guide plate 2*a* and positioned between the idle roll 9 and the top cover 2. This auxiliary document sensor switch SW1 can be actuated by the leading edge of the document being fed downwards along the guide plate 2*a* towards the nipping area between the driven and idle rolls 7 and 9**.

Disposed above the document sensor switch SW2 is a flap 5 having its upper edge portion pivotally supported. This flap 5 is operatively coupled with an actuator of a solenoid assembly SOL1 so that the selective energization and deenergization of the solenoid assembly SOL1 can result in the pivotal movement of the flap 5. More specifically, when the solenoid assembly SOL1 is energized, the flap 5 assumes a position shown by the solid line in FIG. 1, but when the solenoid assembly SOL1 is deenergized, the flap 5 pivots in a direction shown by the arrow K.

The document feeder 61 also comprises a generally rectangular covering 14 stationarily supported with one end portion thereof overhanging the drive belt 12, the other end portion being bent generally about the idle roll 10 so as to extend downwards along and in spaced relation to the left-hand end wall 20 of the housing 31. The space, identified by 59, between the downwardly extending end portion of the covering 14 and the left-hand end wall 20 of the housing 31 constitutes a discharge tunnel through which the document which has been copied can be ejected from the document feeder 61 onto the receiving tray 21 positioned therebelow.

A home position for the first carriage 17 is shown by the phantom line 17' in FIG. 1. The first carriage 17 starts its reciprocal movement in the directions A and B from an overrun position spaced a slight distance leftwards, as viewed in FIG. 1, from the home position 17'. During this movement, the illuminator lamp 55 scans the document placed on the document support 4. The first carriage 17 can also be moved in a direction shown by C towards a position immediately below the document feeder 61 as shown in FIG. 1. This is a retreated position to which the first carriage 17 is brought when a copy-making is carried out by the use of the document feeder 61. The arrival of the first carriage 17 at the home position 17' and at the retreated position can be detected by respective position sensing switches SW3 and SW5.

While the copying machine according to the present invention is constructed as hereinbefore described, the copying machine can be selectively set in two modes one at a time. One of these modes is the mode in which the optical system moves to scan the document placed on the document support 4, and is referred to as a "primary scan mode". The other is the mode at which, while the first carriage 17 is stationarily held at the retreated position, as shown by the solid line in FIG. 1, the document is scanned by the optical system as it is transported between the drive and driven belts 12 and 13, and is referred to as a "secondary scan mode".

Under the primary scan mode, during which the document is placed on the stationary document support 4, the first carriage 17 is held at the overrun position spaced a slight distance from the home position 17' in a direction conforming to the direction C. The first carriage 17 starts its movement in the direction A from the overrun position, and the document on the support 4 is scanned as the first carriage 17 moves from the home position 17' defined by the positions sensing switch SW3. After the first carriage 17 has been moved in the direction A to a predetermined end position, it starts its return movement in the direction B towards the home position and then towards the overrun position. When the first carriage 17 having moved past the home position 17' is brought to a halt, one cycle of the copying operation performed by the copying machine is completed.

During the secondary scan mode wherein the document to be copied is moved by the drive and driven belts 12 and 13 above the first carriage 17 held at the retreated position, the document sensor switch SW1 detects the passage of the leading edge of the document, causing the first carriage 17 to move in the direction C from the overrun position towards the retreated position defined by the position sensing switch SW4. When and after the first carriage 17 has been brought to the retreated position and when a PRINT switch is subsequently manipulated, the driven belt 12 is driven, that is, the motor M2 is driven in one direction to drive the drive belt 12, whereby the document is transported in the direction D while sandwiched between the driven and driven belts 12 and 13. When the optical sensor SW5 detects the trailing edge of the document being moved in the direction D, the motor M2 is deenergized to bring the drive belt 12 to a halt.

In the event of a multiple copying mode in which a predetermined number of identical copies are made from one and the same document, the motor M2 is reversed in the opposite direction to allow the document to be moved in the opposite direction E and, on the other hand, the solenoid assembly SOL1 is energized to permit the document being transported in the direction E to be introduced by the flap 5 in a direction shown by L in FIG. 1. When the optical sensor SW5 subsequently detects the passage of the leading edge of the document with respect to the direction of movement of the document towards the drive roll 8, the motor M2 is rotated again in the one direction to cause the drive and driven belts 12 and 13 to transport the document again in the direction D. Thus, the document is, while sandwiched between the drive and driven belts 12 and 13, reciprocated a number of times equal to the preset number of copies to be made. After the final copy has been made, the motor M2 is rotated in the one direction with the document being transported in the direction D, and finally, the document is ejected, while having been inverted during its passage through the discharge tunnel 59, onto the receiving tray 21 on which the copies have been stacked. Accordingly, simultaneously after the completion of the copy-making under the secondary scan mode, the document can be removed from the receiving tray 21 together with the copies thereof.

Figure 3:
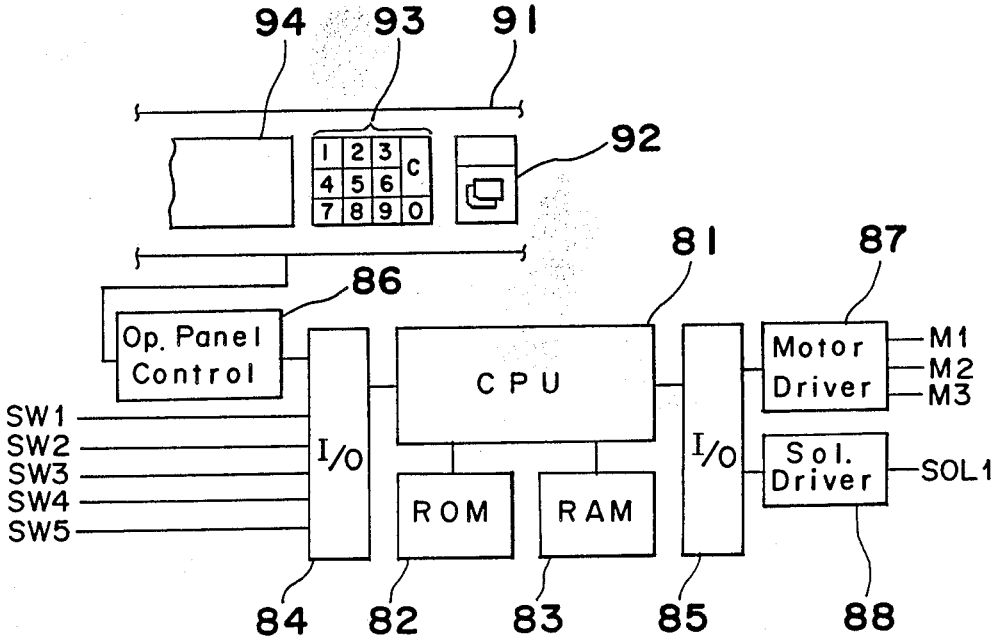
FIG. 3 is a circuit block diagram showing a control device used in the copy machine of the present invention.

FIG. 3 illustrates the control device used in the above described copying machine. A central processing unit (CPU) 81 receives a copy data fed thereto from an operating panel control 86 through an input/output interface 84. The copy data is constituted by ON data descriptive of the actuation of one or more of the PRINT switch 92 and ten keys 93 disposed on an operating panel 91. Also inputted to the CPU 81 through the I/O interface 84 are detection data generated from the document sensor switches SW1 and SW2, the position sensing switch SW3 and SW4, and the optical sensor SW5. The copy date fed to the CPU 81 are stored in associated memory areas of a random access memory (RAM) 83.

A program used to control various devices of the coying machine is stored in a read-only memory (ROM) 82 connected with the CPU 81. Control data appropriate to the copy data which are generated by the CPU 81 according to this program are outputted through input/output interfaces 84 and 85. The outputs emerging from the I/O interface 84 are those to be displayed through a display device 94, and the outputs emerging from the I/O interface 85 are fed to a motor driver 87 and a solenoid driver 88 for controlling electric motors M1 to M3 and the solenoid assembly SOL1.

Figure 4:
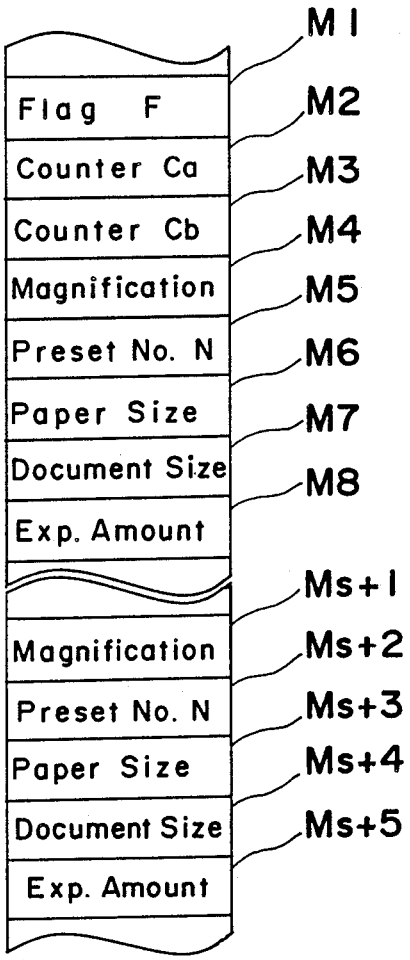
FIG. 4 is a diagram showing a memory map of essential portions in a random access memory used in the control device of the present invention.

FIG. 4 illustrates a memory map of storage areas in the RAM forming a part of the above described control device.

Storage areas M1 to M3 are allocated to a flag F, a counter Ca and a counter Cb, respectively. Storage areas M4 to M8 are used to store the copy data. Similarly, storage areas Ms+1 to Ms+5 are used to store the copy data. The copy data include a copying magnification, a preset number N of copies to be made, the size of copying papers, the size of a document to be copied, and the exposure amount.

Figure 5A:
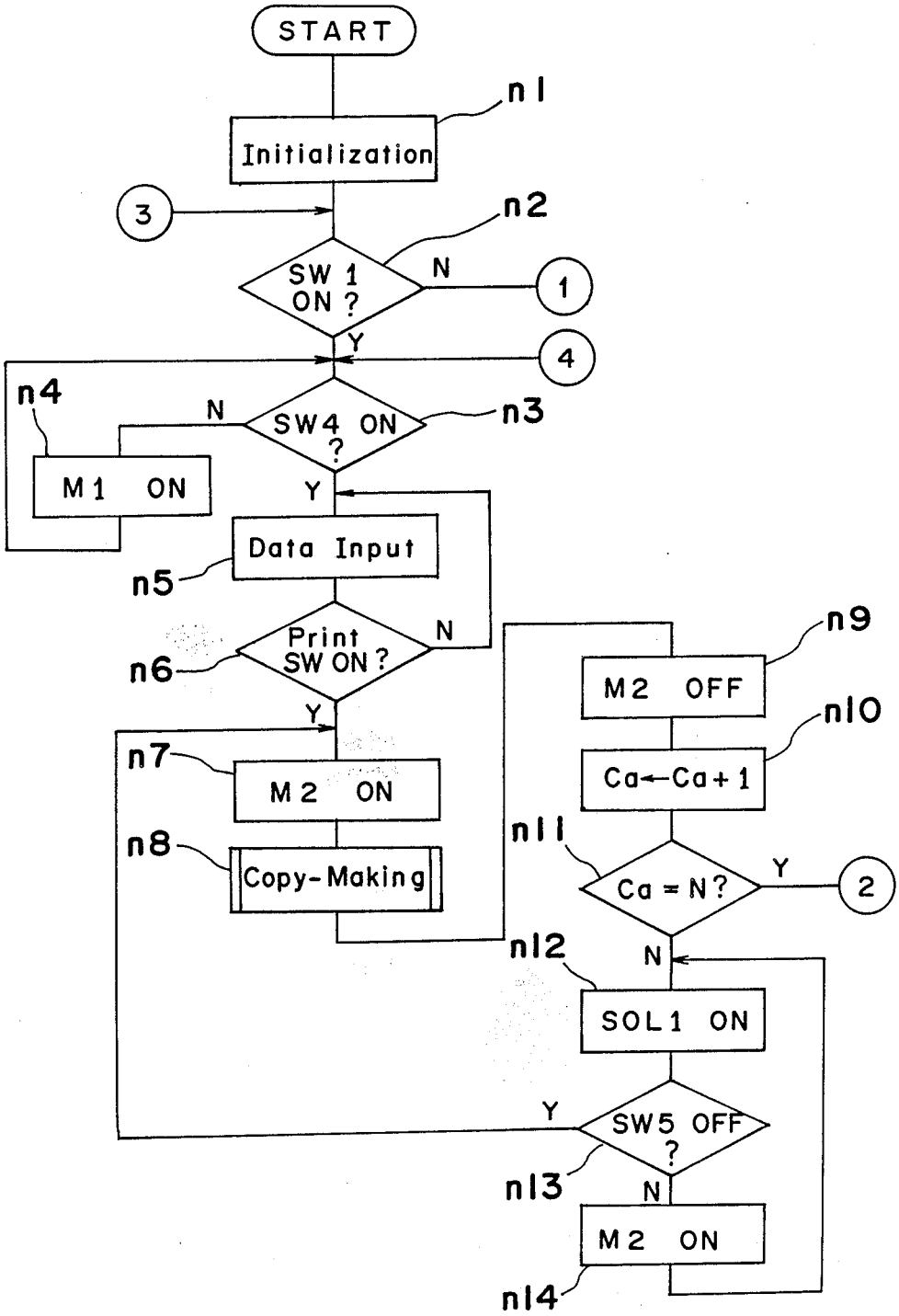
FIGS. 5(*a*) to 5(*c*) altogether illustrate a flowchart showing the sequence of operation of the copying machine.
Figure 5:
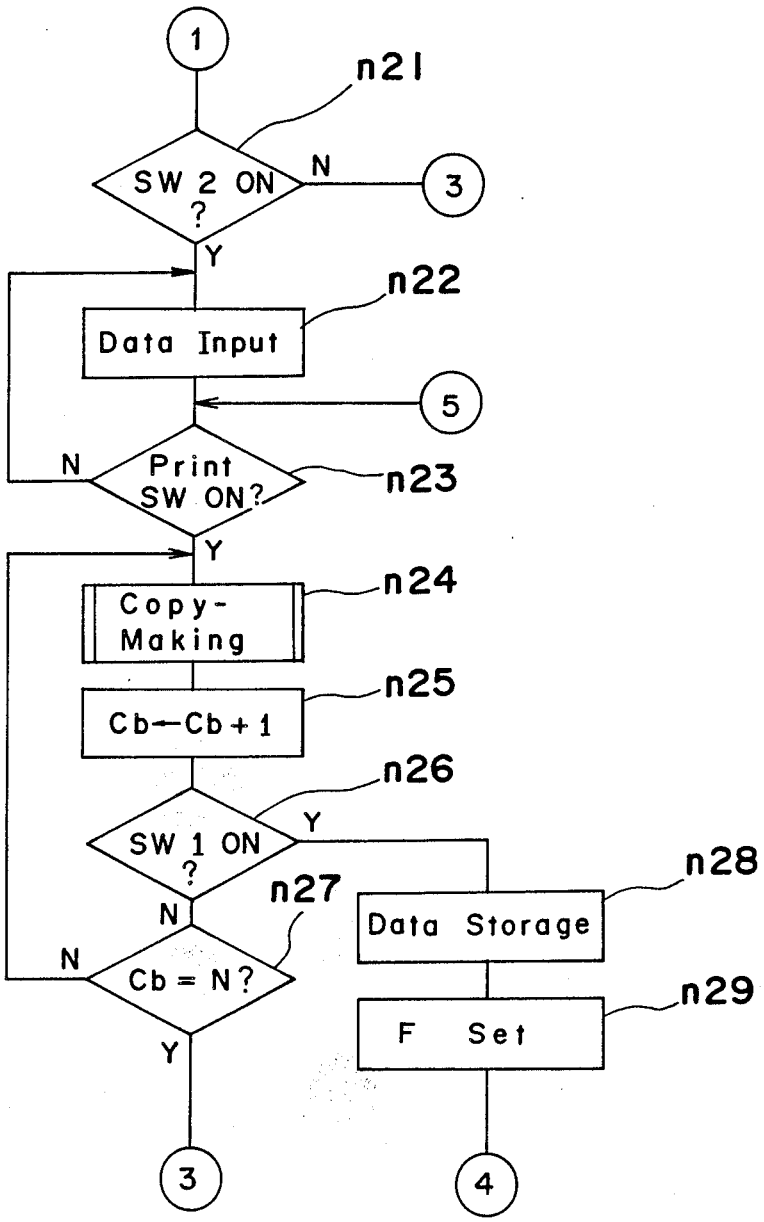
Figure 5:
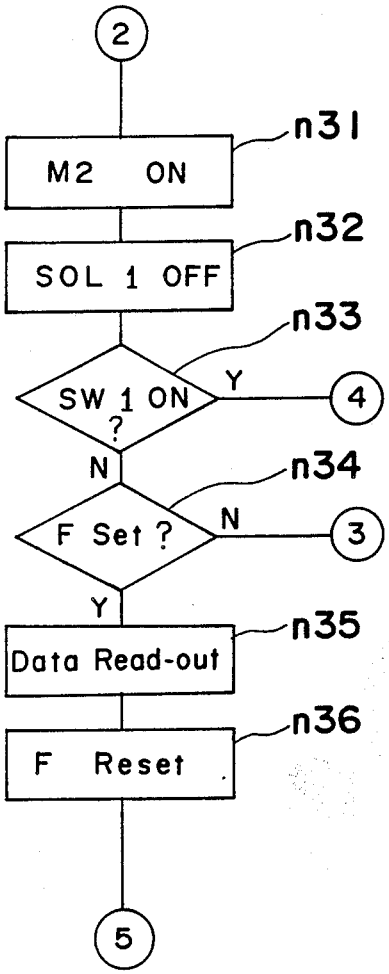

Referring now to FIGS. 5(*a*) to 5(*c*) illustrating the sequence of control of the copying machine embodying the present invention, assuming that the machine is electrically powered, initialization such as the warm-up takes place at step n1, and the machine is held in a wait state until one of the document sensor switches SW1 and SW2 is turned on (n2→n21→n2). If the result of decision at step n2 indicates that the document sensor switch SW1 has been turned on, the motor M1 is driven to move the first carriage 17 to the retreated position at which the position sensing switch SW4 may be turned on. So long as the switch SW4 is not turned on, the motor M1 continues to rotate at n4, but if the result of decision at step n3 indicates that the switch SW4 has been turned on in response to the arrival of the first carriage 17 at the retreated position, the inputting of the copy data is carried out at step n5, followed by a decision at step n6 to determine if the PRINT switch 92 has been manipulated. If the PRINT switch 92 has been manipulated, the motor M2 is driven at step n7 to transport the document above the first carriage 17 in the retreated position in the direction D. In this way, an actual copy-making under the secondary scan mode takes place at step n8.

After the completion of the copy-making, the drive motor M2 is deenergized at step n9, the counter Ca is incremented by one at step n10, followed by step n11 at which the content of the counter is compared with the preset number N. The counter Ca counts the number of copies being made, and accordingly, if the count given by the counter Ca does not coincide with the preset number N, the solenoid assembly SOL1 is energized and, at the same time, the motor M2 is reversed until the optical sensor SW5 is turned off. See steps n12 to n14. When the optical sensor is turned off, the motor M2 is driven in one direction to transport the document in the direction D. This cycle of copying operation is repeated until the count given by the counter Ca coincides with the preset number N, repeating the program flow from step n7 to step n13.

If the result of decision at step n11 indicates that the count by the counter Ca coincides with the preset number N, the motor M2 is driven in the one direction at step n31 and the solenoid assembly SOL1 is deenergized at step n32. The program flow then proceeds to a decision step n33 at which a decision is made to determine if the document sensing switch SW1 has been turned on, that is, if another document has been set in the document feeder 61. Should this switch SW1 be not turned, that is, should no document be set in the document feeder 61, the next subsequent decision is carried out at step n34 to determine if the flag F is set. If the result of decision at step n34 indicates that the flag F is not set, that is, reset, the program flow proceeds to step n2 with the machine consequnetly brought to the wait state. It is, however, to be noted that, if the result of decision at step n33 has indicated that the switch SW1 has been turned on, the program flow returns to step n3.

In the event that the document sensor switch SW2 is turned on while the machine is in the wait state, as indicated by the result of decision at step n21, the inputting of the copy data takes place at step n22, followed by a decision step n23 at which a decision is made to determine if the PRINT switch 92 is turned on under the primary scan mode. If the PRINT switch 92 has been turned on, the copying operation under the primary scan mode is executed at step n24 and the counter Cb is incremented by one at step n25. Unlike the counter Ca, this counter Cb counts the number of copies made under the primary scan mode. Each time a single cycle of copying operation completes, 1 decision is carried out at step n26 to determine if the switch SW1 is turned on, and so long as the switch SW1 is not turned on, another decision is carried out at step n27 to determine if the count given by the counter Cb coincides with the preset number N. If the count by the counter Cb has not yet coincided with the preset number N, the copying operation is repeated until it coincides with the preset number N.

In the event that the result of decision at step n26 indicates that the document sensor switch SW1 is turned on, the copy data stored in the storage areas M4 to M8 of the RAM are transferred to the storage areas Ms+1 to Ms+5 at step n28 and the flag F is set at step n29. This flag F stores a condition descriptive of whether or not an interrupted copying job is initiated with the document set in the document feeder 61. The program flow skips from step n29 to step n3, causing the machine to perform the copying operation under the secondary scan mode in which the document is moved. The program flow from step n26 to step n3 via steps n28 and n29 corresponds to a mode changing means of the present invention.

After the completion of the interrupted copying job in which the copying operation has taken place under the secondary scan mode, the condition of the flag F is checked at step n35 as is the case during the copying operation under the normal secondary scan mode. During the interrupted copying job being performed, the flag F is always set and, accordingly, the program flow proceeds to step n35 at which the copy data are read out from the storage areas Ms+1 to Ms+5 for controlling the various devices of the copying machine. Then, the flag F is reset at step n36 and, thereafter, the program flow returns to step n23. The program flow from step n34 to step n23 via steps n35 and n36 correponds to a mode resuming means of the present invention.

According to the foregoing embodiment as hereinbefore described, each time a cycle of copying operation completes during the execution of a copying job under the primary scan mode, a check is always done to determine whether or not the document sensor switch SW1 is turned on. Therefore, when the document is placed on the document feeder 61 while the copying job is performed under the primary scan mode, a decision is made that the interrupted copying job has arisen and the copying operation under the secondary scan mode is initiated. At this time, the copy data asociated with the copying operation under the primary scan mode then interrupted are transferred to the different storage areas of the memory to enable copy data, associated with the copying operation under the secondary scan mode, to be inputted to the memory. After the completion of the interrupted copying job with the copying operation having been performed under the secondary scan mode, the copy data associated with the copying operation under the primary scan mode are read out from the storage areas Ms+1 to Ms+5 to permit the various devices to resume the respective conditions assumed thereby before the interruption. In view of the foregoing, the initial copying operation under the primary scan mode can be resumed with no need to re-enter the copy data associated therewith.

Figure 6:
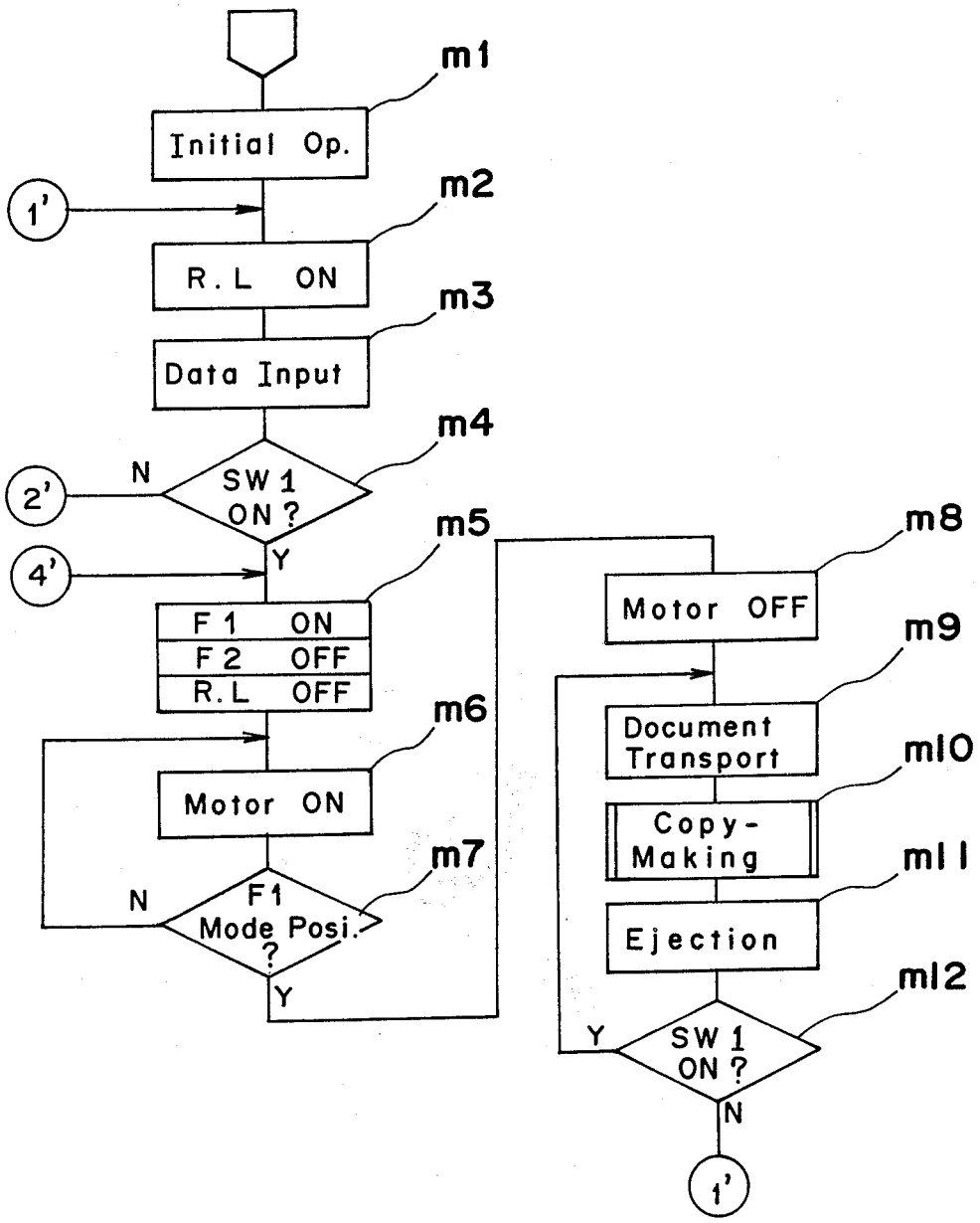
FIGS. 6(*a*) and 6(*b*) altogether illustrate a modified flowchart showing the sequence of operation thereof.
Figure 6:
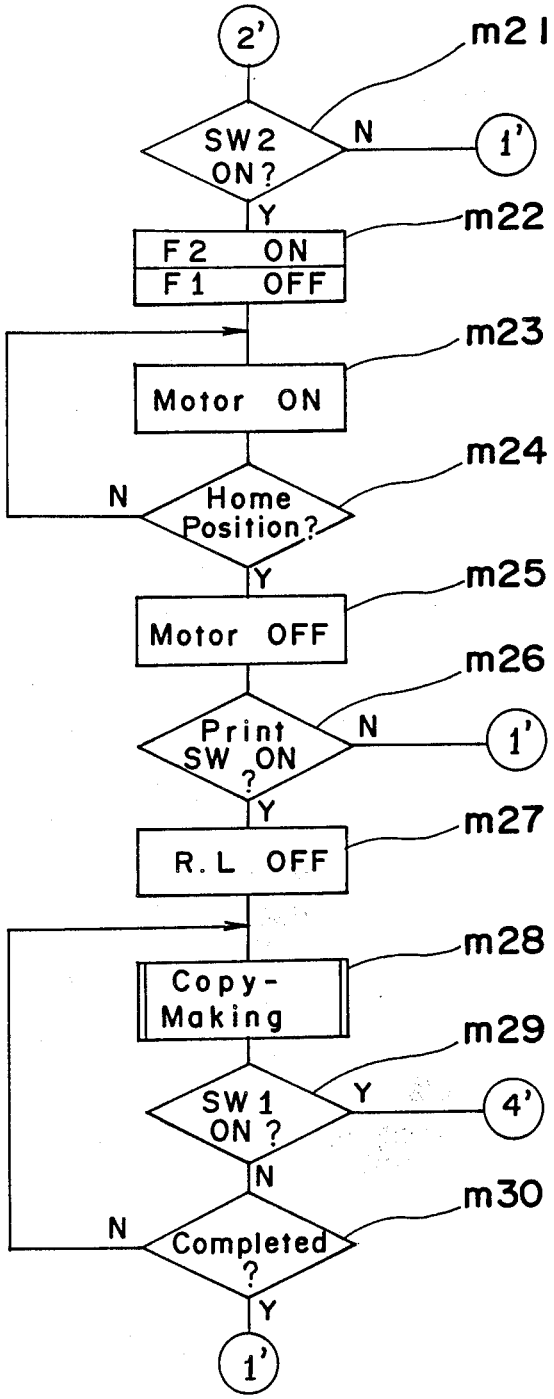

FIGS. 6(*a*) and 6(*b*) illustrate a modified flowchart showing the sequence of control of the copying machine. At step m1 subsequent to the supply of an electric power, initial operations take place to clear the contents of the RAM, to detect whether or not a paper jam occurs inside the machine and to effect a warm-up to increase the temperature of the fixing unit to a value sufficient to fuse toner particles. After the warm-up, and at step m2, a READY lamp is energized to inform that the copying machine is ready to perform a copying operation. At step m3, the operator keys in the preset number of copies desired to be made, the magnification at which a copy is made, the size of copying papers on which the copy is desired to be made, the exposure amount and some other data, all of these data being read in by the control device. At the subsequent step m4, a decision takes place to determine if the document sensor switch SW1 is turned on.

If the result of decision at step m4 indicates that the switch SW1 has been turned on, the program flow proceeds to step m5 at which a flat F1 for the secondary scan mode is switched on, a flag F2 for the primary scan mode is switched off, and the READY lamp is deenergized. Then, the DC motor M1 for driving the first carriage 17 is turned on at step m6 to move the first carriage 17 to the retreated position immediately below the document feeder 6*a*. When the result of the subsequent decision at step m7 has indicated that the first carriage 17 is brought to the retreated position, the DC motor M1 is turned off at step m8 and the drive belt 12 is driven at step m9 to transport the document above the first carriage 17 in the retreated position while the document is sandwiched between the driven and driven belts 12 and 13. Simultaneously with the start of movement of the document over the driven belt 13, the copying operation under the secondary scan mode takes place at step m10. After the preset number of copies has been made, the ejection of the document completes at step m11 with the copies stacked on the receiving tray and with the document overlaying the uppermost one of the copies on the receiving tray 21. Subsequently, and at step m12, a decision is made to determine if the document sensor switch SW1 is turned on. If the next succeeding document is placed on the document feeder 61 and the switch SW1 is consequently turned on, the program flow returns to step m9.

However, if the result of decision at step m12 indicates that the switch SW1 is no longer turned on, the program flow returns to step m2 to carry out the operation under the primary scan mode according to the copy data inputted as hereinbefore described.

Should the result of decision at step m4 indicate that the document sensor switch SW1 is not turned on, the next succeeding decision is carried out at step m21 to determine if the document sensor switch SW2 is turned on. Where the switch SW2 is turned on, the program flow proceeds to step m22 at which the flag F2 for the primary scan mode is switched on and the flag for the secondary scan mode is switched off. At the subsequent step m23, the DC motor M1 is driven to bring the first carriage 17 to the home position 17'.

Only when the first carriage 17 is brought to the home position 17' as determined by a decision at step m24, the DC motor M1 is deenergized at step m25, followed by a decision step m26 to determine if the PRINT switch has been turned on. If the PRINT switch has been turned on, the READY lamp is deenergized at step m27 and the copying operation under the primary scan mode takes place at step m28. After the completion of the copying operation under the primary scan mode at step m30, the program flow returns to step n2. In this way, the copying operation under the primary scan mode in which the optical system moves while the document is held stationary on the document support 4 is carried out.

Should the result of decision at step n21 indicate that the switch SW2 is not turned on, that is, does not detect the document place on the document support 4, or should the result of decision at step m26 indicate that the PRINT switch is not manipulated, the program flow returns to step n2 in either case.

It is to be noted that when the document is inserted in the document feeder 61 during the execution of the copying operation at step m28, the switch SW1 is turned on and, therefore, the decision step m29 is followed by step m5.

The program flow from step m4 to step m5 and from step m21 to step m22 corresponds to a mode setting means of the present invention.

Although the present invention has been fully described in connection with the preferred embodiment thereof with reference to the accompanying drawings, it is to be noted that various changes and modifications are apparent to those skilled in the art. By way of example, the presence or absence of the document placed on the stationary document support may be detected by detecting the closure of the top cover. Such changes and modifications are to be understood as included within the scope of the present invention as defined by the appended claims unless they depart therefrom.

What is claimed is:

1. An electrophotographic copying machine comprising an optical system capable of selectively operating under a primary scan mode, in which a document to be copied, placed on a stationary document support, is scanned by said optical system being moved below the document support, and under a secondary scan mode in which a document to be copied, fed through a document feeder, is moved relative to and above said optical system, a first document sensing means for detecting the placement of a document on the stationary document support;

a second document sensing means for detecting the insertion of a document into the document feeder;

a mode setting means for selectively setting the machine so as to operate under either said primary scan mode when said first document sensing means has detected the placement of the document on a stationary document support, and under said secondary scan mode when said second document sensing means has detected the insertion of said document into said document feeder; and a mode changing means capable of interrupting the operation of said copying machine under said primary scan mode immediately after the completion of the copying operation under the primary scan mode and initiating the operation under the secondary scan mode, in the event that a document is inserted in the document feeder during the execution of the copying operation under the primary scan mode, said document feeder including a reciprocal belt transport system which conveys the document to be copied during said secondary scan mode such that a multiplicity of copies can be made in said secondary scan mode of said document inserted into said document feeder means.

2. An electrophotographic copying machine which comprises:

a stationary document support for a document to be copied;

an optical system provided for movement below the stationary document support;

a document feeding means for transporting a document to be copied over said optical system when said optical system is held in a stationary position;

a mode setting means such that said machine is capable of selectively operating either under a primary scan mode is in which the document placed on the stationary document support is scanned by the optical system which is moved immediately below the document support, or under a secondary scan mode in which the document to be copied is transported above the optical system by said document feeding means while said optical system is held in a stationary position;

document sensing means for detecting placement of a document on said stationary document support and for detecting the insertion of a document into said document feeding means;

a mode changing means operable, in the event that said respective document sensing means detects the insertion of a document into said document feeding means during the execution of said copying operation under the primary scan mode, to interrupt the copying operation under the primary scan mode immediately after the completion of a cycle of the copying operation under said primary scan mode and to execute the copying operation under the secondary scan mode; and a mode resuming means for causing the machine to resume the copying operation under the primary scan mode immediately after the completion of the copying operation under the secondary scan mode set by the mode changing means;

wherein said stationary document support is provided with a top cover for urging a document against said document support, said top cover being provided further with a guide for directing documents to be copied towards said document feeding means.

3. The electrophotographic copying machine of claim 2, wherein said document feed means comprises a belt transport system which conveys a document to be copied under said secondary scan mode.

4. The electrophotographic copying machine of claim 3, wherein said belt transport system is reciprocal in nature such that it can be driven in opposite directions to make a multiplicity of copies of said document introduced to said document feeder means.

5. The electrophotographic copying machine of claim 3, wherein said document to be copied by way of said secondary scan mode is so oriented such that the image of said document is oriented in the same direciton as the corresponding image produced on copying paper after the document has been exposed and scanned.

6. The electrophotographic copying machine of claim 5, wherein said document feeding means further includes a covering member which functions as a paper guide operable to invert said document being copied by way of said secondary scan mode.

* * * * *